US011871807B1

(12) United States Patent
Kim

(10) Patent No.: US 11,871,807 B1
(45) Date of Patent: Jan. 16, 2024

(54) CAP

(71) Applicant: Jong San Kim, Busan (KR)

(72) Inventor: Jong San Kim, Busan (KR)

( * ) Notice: Subject to any disclaimer, the term of this patent is extended or adjusted under 35 U.S.C. 154(b) by 0 days.

(21) Appl. No.: 18/183,141

(22) Filed: Mar. 13, 2023

(30) Foreign Application Priority Data

Sep. 6, 2022 (KR) ..... 10-2022-0113085

(51) Int. Cl.
*A42B 1/22* (2006.01)
*A42B 7/00* (2006.01)
*A42B 1/0182* (2021.01)

(52) U.S. Cl.
CPC ..... *A42B 1/225* (2013.01); *A42B 1/22* (2013.01); *A42B 7/00* (2013.01); *A42B 1/0182* (2021.01)

(58) Field of Classification Search
CPC ..... A42B 1/22; A42B 1/225; A42B 1/0182; A42B 7/00; A42C 5/04; A45D 8/30; Y10T 24/32
USPC ..... D2/884
See application file for complete search history.

(56) References Cited

U.S. PATENT DOCUMENTS 1,017,372 A * 2/1912 Belasco ..... A42B 7/00 132/130
1,058,323 A * 4/1913 Mueller ..... A42B 7/00 132/57.1
2,192,080 A * 2/1940 Hock ..... A42B 1/12 2/68
2,647,264 A * 8/1953 Hutton ..... A42B 1/12 2/200.2
2,711,744 A * 6/1955 Kaplan ..... A42B 7/00 132/59
2,760,201 A * 8/1956 Kahn ..... A42B 1/12 441/124
3,026,526 A * 3/1962 Montrose ..... A42B 1/12 2/68
3,505,683 A * 4/1970 Wright ..... A42B 7/00 2/200.1
4,021,891 A * 5/1977 Morita ..... A45C 13/1069 24/303
4,281,417 A * 8/1981 Valentine ..... A42B 1/12 2/68
4,453,294 A * 6/1984 Morita ..... E05C 19/16 24/66.1
4,951,320 A * 8/1990 Yoon ..... A42C 5/04 2/181.2

(Continued)

FOREIGN PATENT DOCUMENTS

JP 3090122 U 11/2002
KR 20-0192556 Y1 8/2000
KR 10-2013-0112223 A 10/2013

*Primary Examiner* — Heather Mangine
(74) *Attorney, Agent, or Firm* — KORUS Patent, LLC; Seong Il Jeong

(57) ABSTRACT

The present disclosure relates to a cap with a new structure that can be easily worn by people with long hair. In the cap according to the present disclosure, since a male button (42) provided on a strap (30) is coupled to a female button (41) provided on a side surface of a crown (10), the strap (30) may be configured to be sufficiently long. Accordingly, after a user wears the cap, the strap (30) may be passed under the hair and fixed using button members (41, 42). Thus, there are advantages that it is not necessary to take out the hair by passing the hair through an opening (11) and it is more convenient to wear the cap.

3 Claims, 4 Drawing Sheets

(56) References Cited

U.S. PATENT DOCUMENTS 5,572,746 A * 11/1996 Linico ..... A42C 5/04 2/182.2
5,625,901 A * 5/1997 Healy ..... A42C 5/04 2/182.2
5,638,836 A * 6/1997 Yasuda ..... A45D 8/30 132/273
5,647,101 A * 7/1997 Morita ..... A41F 1/002 24/303
5,666,670 A * 9/1997 Ryan ..... A42B 3/0406 2/209.7
5,787,507 A * 8/1998 Sullivan ..... A42B 7/00 2/182.2
5,875,494 A * 3/1999 Garnier, Jr. ..... A42B 1/225 2/171.5
5,894,850 A * 4/1999 Kimura ..... A45D 8/20 132/279
5,933,872 A * 8/1999 Lema ..... A42B 1/225 2/209.3
6,446,639 B1 * 9/2002 Shyu ..... A45D 8/20 132/277
7,962,971 B1 * 6/2011 Spence ..... A42B 1/206 2/171.7
D668,843 S * 10/2012 Lalonde ..... D2/881
8,359,668 B2 * 1/2013 Elliott ..... A42C 5/02 2/181
2004/0210985 A1 * 10/2004 Lee ..... A61F 9/045 2/171
2006/0137074 A1 * 6/2006 Laing ..... A42B 1/225 2/195.2
2006/0150304 A1 * 7/2006 Bentz ..... A42B 3/08 2/421
2008/0092272 A1 * 4/2008 Vainio ..... A42B 1/225 2/209.3
2008/0201825 A1 * 8/2008 Chun ..... A42B 1/225 2/209.13
2009/0255030 A1 * 10/2009 Guy ..... A42B 1/225 2/195.3
2010/0180906 A1 * 7/2010 Marozsan ..... A42B 7/00 132/65.1
2013/0111650 A1 * 5/2013 Hong ..... A42B 1/225 2/209.13
2014/0082826 A1 * 3/2014 Kuthari ..... A42B 1/225 2/171.7
2014/0338092 A1 * 11/2014 Kinsey ..... A42B 1/048 2/84
2017/0318890 A1 * 11/2017 Stolker ..... A42B 3/069
2018/0055127 A1 * 3/2018 Plon ..... A42B 1/0182
2018/0146734 A1 * 5/2018 Kelly ..... A42B 1/004
2019/0021466 A1 * 1/2019 Earhart ..... A45D 8/30
2019/0298007 A1 * 10/2019 Velger ..... A42B 1/225
2020/0297057 A1 * 9/2020 Davis ..... A42B 1/0184
2020/0305531 A1 * 10/2020 Harry ..... A42B 1/225
2021/0045472 A1 * 2/2021 Abedinzadeh Kivi ..... A62B 18/025
2021/0093033 A1 * 4/2021 Hooker ..... A42B 1/225
2022/0022584 A1 * 1/2022 Yim ..... A42B 1/225
2022/0117333 A1 * 4/2022 McCreesh ..... A62B 17/04
2022/0264982 A1 * 8/2022 Binns ..... A42B 1/22
2022/0264983 A1 * 8/2022 Oh ..... F21V 33/0008
2022/0330642 A1 * 10/2022 Basra ..... A45C 9/00
2022/0346482 A1 * 11/2022 Hodgdon ..... A42B 1/0186
2023/0148696 A1 * 5/2023 Bisagno ..... A42B 1/12 2/68

* cited by examiner

CAP

CROSS-REFERENCE TO RELATED APPLICATION

This application claims priority to and the benefit of Korean Patent Application No. 2022-0113085, filed on Sep. 6, 2022, the disclosure of which is incorporated herein by reference in its entirety.

BACKGROUND

1. Field of the Invention

The present disclosure relates to a cap with a new structure that can be easily worn by people with long hair.

2. Discussion of Related Art

FIG. 1 illustrates an example of a ball cap casually worn when taking a walk or exercising. The ball cap includes a crown 10 having a dome shape and a bill 20 disposed in front of the crown 10, and when a user wears the ball cap with the crown covering the head, the bill is positioned above the face and protects the face from sunlight or the like.

Here, an opening 11 extending upward is formed in a rear side of the crown 10 of the ball cap, and a strap 30 is disposed at a lower side of the opening 11 so that an area of the opening 11 can be adjusted using the strap 30.

Meanwhile, when a user with long hair, especially, a ponytail hairstyle, wears the ball cap, the strap 30 presses the hair and the user may feel discomfort, and thus it is common to gather the hair and take out the hair by passing the hair through the opening 11 when wearing the ball cap.

However, for the user to pass the hair through the opening 11 as above, the user should first wear the cap and then take out the hair by pulling the hair through an upper side of the strap 30, and thus there is a problem that it is very inconvenient.

Such a problem identically occurs in all types of caps having the crown 10, in addition to the above-described ball cap.

Accordingly, there is a need for a new method which can address the problem.

RELATED ART DOCUMENT

[Patent Document]

(Patent Document 1) Korean Utility Model Registration No. 20-0251921

SUMMARY OF THE INVENTION

The present disclosure is directed to providing a cap with a new structure that can be easily worn by people with long hair.

The present disclosure provides a cap including a crown (10) configured to cover a user's head while the cap is worn by the user, an opening (11) formed to extend upward in a rear side of the crown (10), and a strap (30) disposed at a lower side of the opening (11), wherein one end of the strap (30) is coupled and fixed to one side of the opening (11), and button members (41, 42) coupled to be attachable to and detachable from each other are disposed on a side surface of the crown (10) and a front end of the strap (30), respectively, so that the strap (30) is able to be fixed to the side surface of the crown (10) using the button members (41, 42).

According to another feature of the present disclosure, the button members (41, 42) may include a female button (41) which has a fixing groove (41*a*) formed on one side and is fixed to the side surface of the crown (10) and a male button (42) which has a protrusion (42*a*) formed thereon to be coupled to the fixing groove (41*a*) and is fixed to the strap (30), and a magnet member may be disposed on the female button (41) or the male button (42) so that the female button (41) and the male button (42) are coupled to be attachable to and detachable from each other using a magnetic force of the magnet member.

According to still another feature of the present disclosure, the cap may further include a support panel (31) which is made of a synthetic resin material and disposed inside the strap (30) wherein the support panel (31) includes a bent portion (32) bent to protrude outward and disposed in an intermediate portion of the strap (30).

According to yet another feature of the present disclosure, the cap may further include a plurality of brush members (33) each formed in the shape of a pin extending forward from the bent portion (32) of the strap (30) and configured to be combined with the user's hair to fix the hair.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, the present disclosure will be described in detail with reference to the accompanying drawings.

Figure 1:
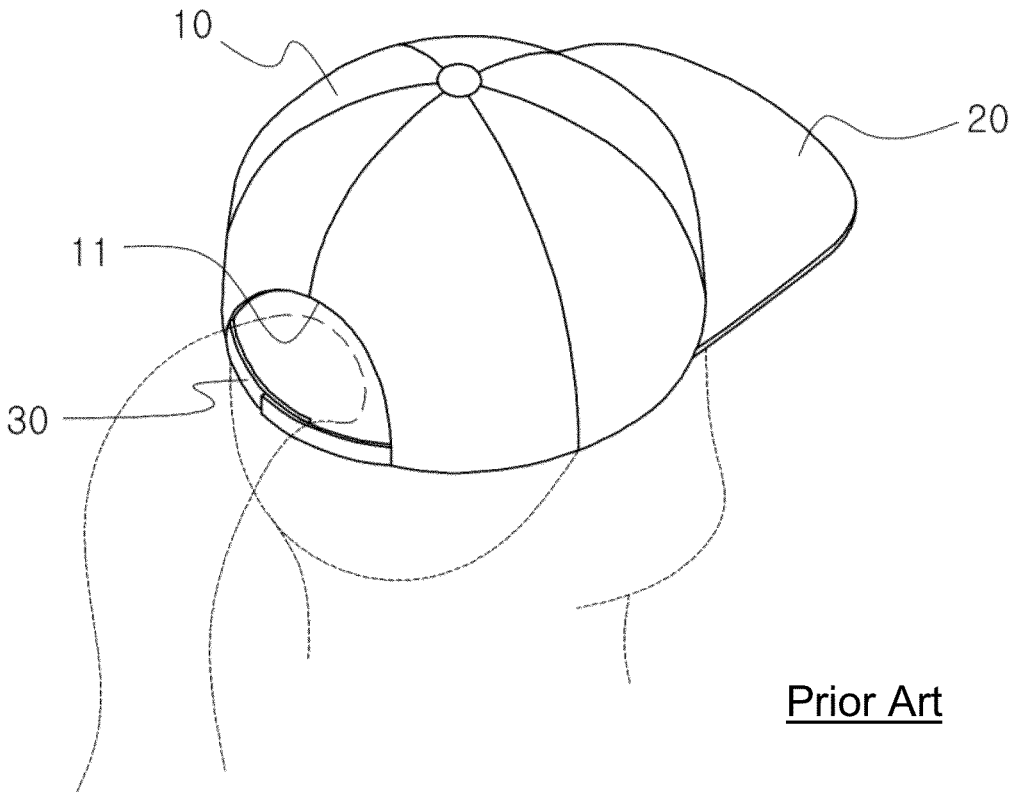
FIG. 1 is a reference view illustrating a conventional cap.
Figure 2:
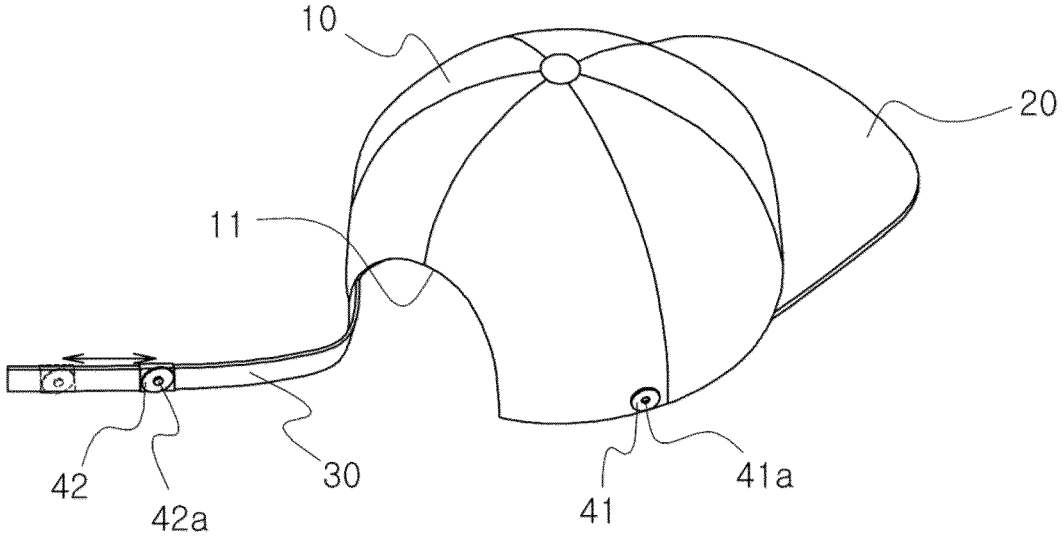
FIG. 2 is a perspective view illustrating a cap according to the present disclosure.
Figure 3:
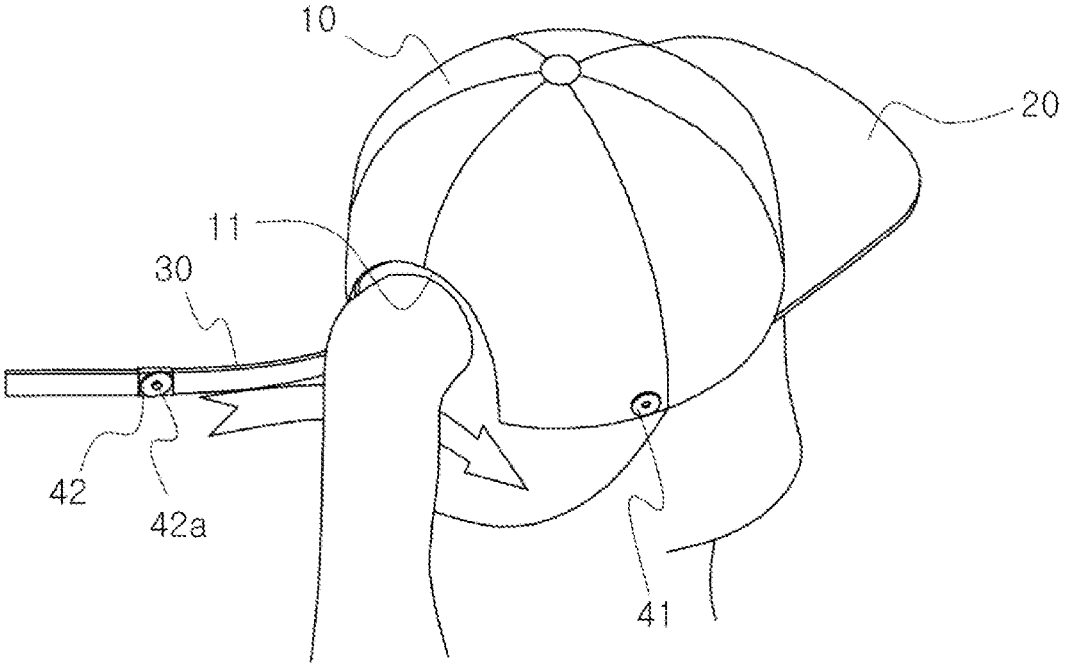
FIGS. 3 and 4 are reference views illustrating a method of wearing the cap according to the present disclosure.
Figure 4:
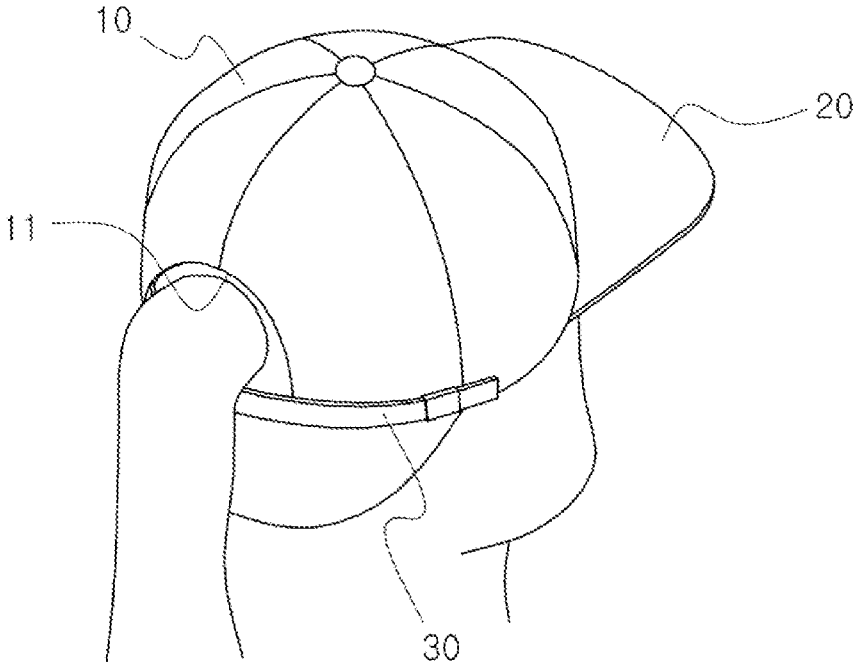

FIGS. 2 to 4 illustrate a cap according to the present disclosure and illustrate the case in which the present disclosure is applied to a ball cap including a crown 10 having a dome shape and a bill 20 disposed in front of the crown 10.

Here, an opening 11 extending upward is formed in a rear side of the crown 10, and a strap 30 is disposed at a lower side of the opening 11.

Also, according to the present disclosure, one end (a left side end in the drawings) of the strap 30 is coupled and fixed to one side of the opening 11, and button members 41 and 42 coupled to be attachable to and detachable from each other are disposed on a side surface of the crown 10 and a front end of the strap 30, respectively, so that the strap 30 is able to be fixed to the side surface of the crown 10 using the button members 41 and 42.

The button members 41 and 42 include a female button 41 which has a fixing groove 41*a* formed on one side and is fixed to a side surface (a right side surface in the drawings) of the crown 10 and a male button 42 which has a protrusion 42*a* formed on one side thereof to be coupled to the fixing groove 41*a* and is position-adjustably coupled to the strap 30.

Here, a magnet member is disposed on the female button 41 or the male button 42 so that the female button 41 and the male button 42 are coupled to be attachable to and detachable from each other using a magnetic force of the magnet member.

Accordingly, the cap may be worn as illustrated in FIG. 3 in a state in which the female button 41 and the male button 42 are separated so that a lower end of the opening 11 is open as illustrated in FIG. 2, and the strap 30 may be passed under the hair as indicated by an arrow in FIG. 3, and then the female button 41 and the male button 42 may be coupled to each other to fix the strap 30 as illustrated in FIG. 4.

In the cap configured as above, since the male button 42 provided on the strap 30 is coupled to the female button 41 provided on the side surface of the crown 10, the strap 30 may be configured to be sufficiently long, and accordingly, after a user wears the cap, the strap 30 may be passed under the hair and fixed using the button members 41 and 42, thus having advantages that it is not necessary to take out the hair by passing the hair through the opening 11 and it is more convenient to wear the cap.

In particular, since the length of the strap 30 is increased, there are advantages that the user may carry the cap while holding the strap 30 and it becomes easy to fix the cap to a bag or other objects using the strap 30.

Although the case in which the present disclosure is applied to a ball cap has been described in the above embodiment, the present disclosure may also be applied to any other types of caps as long as the cap includes the opening 11 and the strap 30.

Figure 5:
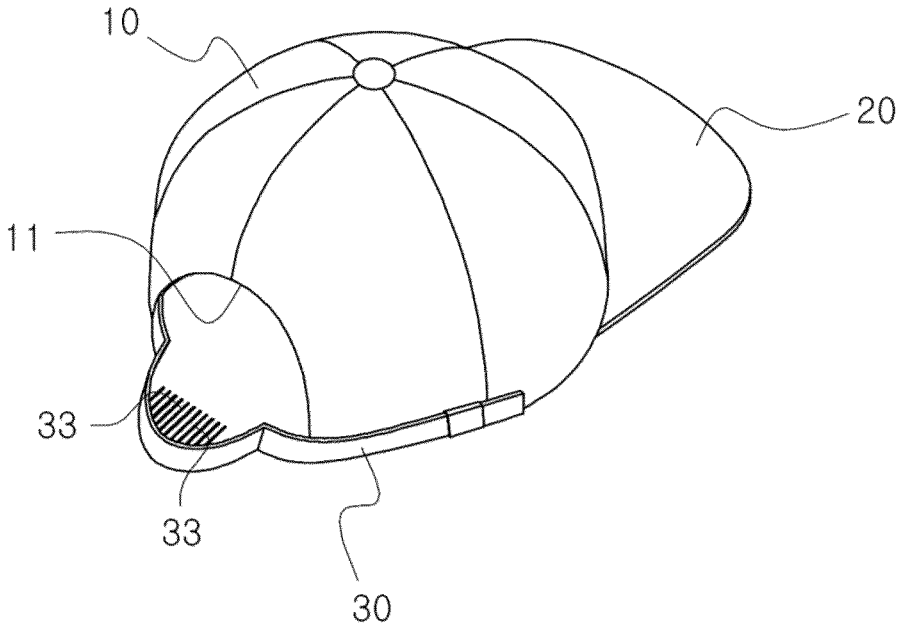
FIG. 5 is a perspective view illustrating a cap according to a second embodiment of the present disclosure.
Figure 6:
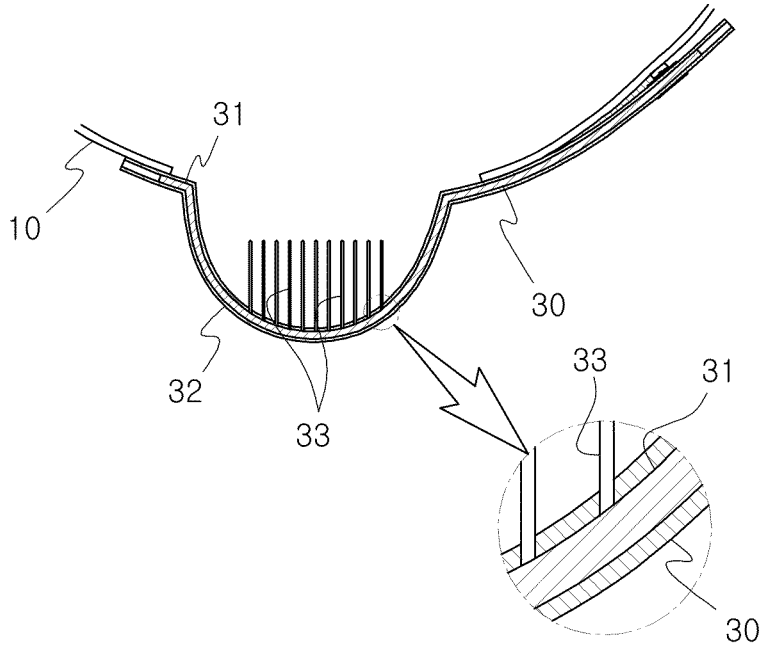
FIG. 6 is a plan cross-sectional view illustrating a main part of the cap according to the second embodiment of the present disclosure.
Figure 7:
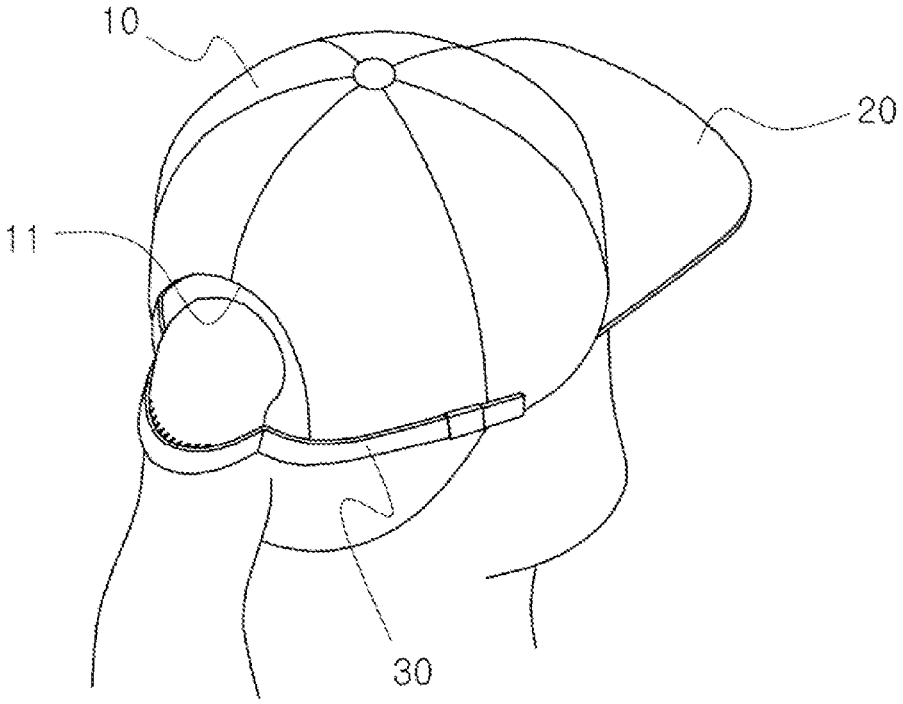
FIG. 7 is a perspective view illustrating a state in which the cap according to the second embodiment of the present disclosure is worn.

FIGS. 5 to 7 illustrate another embodiment according to the present disclosure in which a bent portion 32 bent to protrude outward is disposed in an intermediate portion of the strap 30.

To this end, the strap 30 is manufactured using fabric so that a space is formed therein, and a support panel 31 which is made of a synthetic resin material is disposed inside the strap 30.

The support panel 31 is formed in the shape of a thin band extending in a lateral direction and is inserted into the strap 30 and fixed to elastically support the strap 30 wherein the support panel 31 includes a bent portion 32 bent to protrude outward, the bent portion 32 being disposed in an intermediate portion of the strap 30.

Also, a plurality of brush members 33 each extending forward are disposed on the bent portion 32 of the strap 30 so that the user's hair may be fixed using the brush members 33.

The brush members 33 are each formed in the shape of a pin extending forward from a front surface of the support panel 31 to pass through a front surface of the strap and the plurality of brush members 33 are formed to be spaced apart from each other in the lateral direction.

Accordingly, when the user wears the cap so that the hair passes through an inner side of the bent portion 32 as illustrated in FIG. 7, while the hair is not flattened out, the brush members 33 are combined with the hair and fix the hair and the cap to prevent movement thereof. Thus, there is an advantage that the user can more conveniently wear the cap.

In the cap according to the present disclosure, since the male button 42 provided on the strap 30 is coupled to the female button 41 provided on a side surface of the crown 10, the strap 30 may be configured to be sufficiently long. Accordingly, after a user wears the cap, the strap 30 may be passed under the hair and fixed using the button members 41 and 42. Thus, there are advantages that it is not necessary to take out the hair by passing the hair through the opening 11 and it is more convenient to wear the cap.

What is claimed is:

1. A cap comprising:

a crown (10) configured to cover a user's head while the cap is worn by the user;

an opening (11) formed to extend upward in a rear side of the crown (10); and a strap (30) made of fabric and disposed at a lower side of the opening (11), the strap (30) having a space formed therein, wherein one end of the strap (30) is coupled and fixed to one side of the opening (11), a first button members (41) and a second button member (42) coupled to be attachable to and detachable from each other are disposed on a side surface of the crown (10) and a front end of the strap (30), respectively, so that the strap (30) is able to be fixed to the side surface of the crown (10) using the first and second button members (41, 42), and the cap further includes a support panel (31) which is made of a synthetic resin material and disposed in the space in the strap (30), wherein the support panel (31) comprises a bent portion (32) bent to protrude outward and disposed in an intermediate portion of the strap (30).

2. The cap of claim 1, wherein:

the first button members (41, 42) a female button (41) which has a fixing groove (41*a*) formed on one side and is fixed to the side surface of the crown (10) and the second button member (42) is a male button (42) which has a protrusion (42*a*) formed thereon to be coupled to the fixing groove (41*a*) and is fixed to the strap (30); and a magnet member is disposed on the female button (41) or the male button (42) so that the female button (41) and the male button (42) are coupled to be attachable to and detachable from each other using a magnetic force of the magnet member.

3. The cap of claim 1, further comprising a plurality of brush members (33) each formed in a shape of a pin extending forward from the bent portion (32) and configured to be combined with the user's hair to fix the hair.

* * * * *